US010451331B2

(12) United States Patent
Shin et al.

(10) Patent No.: US 10,451,331 B2
(45) Date of Patent: Oct. 22, 2019

(54) REFRIGERATOR HAVING DEFROSTING DEVICE

(71) Applicant: LG ELECTRONICS INC., Seoul (KR)

(72) Inventors: Gyuwon Shin, Seoul (KR); Kyungroc Moon, Seoul (KR); Jinwoo Kwag, Seoul (KR)

(73) Assignee: LG Electronics Inc., Seoul (KR)

( * ) Notice: Subject to any disclaimer, the term of this patent is extended or adjusted under 35 U.S.C. 154(b) by 184 days.

(21) Appl. No.: 15/536,415

(22) PCT Filed: Dec. 15, 2015

(86) PCT No.: PCT/KR2015/013702

§ 371 (c)(1),
(2) Date: Jun. 15, 2017

(87) PCT Pub. No.: WO2016/099107

PCT Pub. Date: Jun. 23, 2016

(65) Prior Publication Data

US 2017/0343270 A1 Nov. 30, 2017

(30) Foreign Application Priority Data

Dec. 15, 2014 (KR) ..... 10-2014-0180559

(51) Int. Cl.
*F25D 21/08* (2006.01)
*F28D 15/02* (2006.01)
(Continued)

(52) U.S. Cl.
CPC ..... *F25D 21/08* (2013.01); *F25D 17/065* (2013.01); *F28D 15/02* (2013.01); *F25B 39/02* (2013.01)

(58) Field of Classification Search
CPC ..... F25B 39/02; F25D 17/065; F25D 21/08; F28D 15/02
See application file for complete search history.

(56) References Cited

U.S. PATENT DOCUMENTS 4,369,350 A * 1/1983 Kobayashi ..... F25D 21/08 219/201
6,375,136 B1 * 4/2002 Bruemmer ..... B60S 1/04 15/250.25

(Continued)

FOREIGN PATENT DOCUMENTS

CN 1239866 2/2006
CN 100439831 12/2008

(Continued)

OTHER PUBLICATIONS

Supplementary European Search Report in European Application No. 15870274.6, dated Aug. 27, 2018, 7 pages.

(Continued)

*Primary Examiner* — Henry T Crenshaw
(74) *Attorney, Agent, or Firm* — Fish & Richardson P.C.

(57) ABSTRACT

The present invention relates to a refrigerator having a defrosting device, the refrigerator comprising: a refrigerator main body; an evaporator provided in the refrigerator main body; a defrosting heater provided at the lower side of the evaporator so as to emit heat when a power source is applied; and a heat pipe for transferring heat to the evaporator, one side of the heat pipe being arranged so as to be able to transfer heat to one side of the defrosting heater, and the other side of the heater pipe extending to the upper side along the vertical direction of the evaporator. Thereby, the present invention can shorten defrosting time and reduce power consumption.

12 Claims, 13 Drawing Sheets

(51) Int. Cl.
*F25D 17/06* (2006.01)
*F25B 39/02* (2006.01)

(56) References Cited

U.S. PATENT DOCUMENTS

| | | | | |
|---|---|---|---|---|
| 2002/0036076 | A1* | 3/2002 | Eastman | F28D 15/0266 165/45 |
| 2002/0088238 | A1* | 7/2002 | Holmes | F25D 21/006 62/155 |
| 2005/0194122 | A1* | 9/2005 | Wert | F28D 15/025 165/104.21 |
| 2006/0278374 | A1* | 12/2006 | Hao | F28D 15/0266 165/104.33 |
| 2010/0025548 | A1* | 2/2010 | Grivas | F24F 1/0003 248/62 |
| 2013/0219930 | A1* | 8/2013 | Shin | F25B 29/003 62/79 |

FOREIGN PATENT DOCUMENTS

| | | |
|---|---|---|
| EP | 1369650 | 12/2003 |
| JP | 19931227 | 12/1993 |
| JP | H05-346284 | * 12/1993 |
| KR | 10-1992-0015105 | 8/1992 |
| KR | 10-1996-000257 | 8/1992 |
| KR | 960002571 | 2/1996 |
| KR | 10-2003-0094279 | 12/2003 |
| KR | 10-2004-0014137 | 2/2004 |
| KR | 10-2011-0121862 | 11/2011 |
| KR | 1020110121862 | 11/2011 |

OTHER PUBLICATIONS

Chinese Office Action in Chinese Appln. No. 201580068451.1, dated Jan. 21, 2019, 12 pages (with English translation).

* cited by examiner

REFRIGERATOR HAVING DEFROSTING DEVICE

CROSS-REFERENCE TO RELATED APPLICATIONS

This application is the National Stage filing under 35 U.S.C. 371 of International Application No. PCT/KR2015/013702, filed on Dec. 15, 2015, which claims the benefit of earlier filing date and right of priority to Korean Application No. 10-2014-0180559, filed on Dec. 15, 2014, the contents of which are all hereby incorporated by reference herein in their entirety.

TECHNICAL FIELD

The present invention relates to a refrigerator having a defrosting device, and more particularly, to a refrigerator having a defrosting device, capable of reducing a power consumption during a defrosting operation and capable of reducing a defrosting time.

BACKGROUND ART

As is well known, a refrigerator is an apparatus to store food at a low temperature, and to keep the food for a longer time in a fresh state.

The refrigerator is provided with a storage chamber for storing food items, and a refrigerating cycle apparatus for providing cold air to the storage chamber.

As the refrigerating cycle apparatus, generally used is a vapor compression type refrigerating cycle apparatus for compressing, condensing, expanding and evaporating a refrigerant.

Once the refrigerating cycle apparatus is driven, frost is generated on a surface of an evaporator due to condensation of moisture in the air.

If the amount of frost on the surface of the evaporator is increased, efficiency of heat exchange between air and a refrigerant inside the storage chamber is lowered. As a result, an inner temperature of the storage chamber is increased.

The refrigerator performs a defrosting operation for removing frost on the surface of the evaporator in a heating manner, at a preset time or if a condition is satisfied.

The evaporator is provided with a defrosting heater for removing frost on the evaporator in a heating manner.

However, in the conventional refrigerator, when the defrosting heater is installed only below the evaporator, a defrosting time may be increased.

Further, in case of installing an electric heater both above and below the evaporator for a shortened defrosting time, power consumption may be increased.

DISCLOSURE

Technical Problem

Therefore, an object of the present invention is to provide a refrigerator having a defrosting device capable of reducing a defrosting time and reducing power consumption.

Another object of the present invention is to provide a refrigerator having a defrosting device capable of preventing damage of components, and capable of smoothly performing a heat transfer.

Another object of the present invention is to provide a refrigerator having a defrosting device capable of preventing leakage of operation fluid through a welding portion by excluding a welding process.

Another object of the present invention is to provide a refrigerator having a defrosting device capable of rapidly and easily performing a coupling operation between components.

Another object of the present invention is to provide a refrigerator having a defrosting device capable of easily installing components without lowering heat exchange efficiency of an evaporator.

Technical Solution

To achieve these and other advantages and in accordance with the purpose of the present invention, as embodied and broadly described herein, there is provided a refrigerator having a defrosting device, comprising: a refrigerator main body; an evaporator provided at the refrigerator main body; a defrosting heater provided below the evaporator so as to emit heat when a power is applied thereto; and a heat pipe having one side arranged at one side of the defrosting heater so as to transfer heat, having another side upward extending in upper and lower directions of the evaporator, and configured to transfer heat to the evaporator.

The heat pipe may include: an evaporating portion provided at one side of the defrosting heater; a condensing portion spaced apart from the evaporating portion; and a connecting portion for connecting the evaporating portion and the condensing portion with each other.

The refrigerator having a defrosting device may further comprise a supporting holder for supporting the heat pipe in a spaced manner from the defrosting heater by a preset interval.

The supporting holder may be formed to have a plate shape, and is coupled to a refrigerant pipe of the evaporator.

The supporting holder may include: a defrosting heater accommodating portion for accommodating the defrosting heater therein; and a heat pipe accommodating portion for accommodating the heat pipe therein in a spaced state from the defrosting heater accommodating portion by the preset distance.

The supporting holder may be provided with a heat pipe fixing pieces for fixing the heat pipe by being bent in order to prevent separation of the heat pipe accommodated in the heat pipe accommodating portion.

The heat pipe accommodating portion may be formed above the defrosting heater accommodating portion.

The heat pipe accommodating portion may be formed outside the defrosting heater accommodating portion in a diagonal direction, based on a center of the evaporator in a thickness direction.

The supporting holder may be provided with a defrosting heater supporting piece provided at the defrosting heater accommodating portion, the defrosting heater supporting piece for supporting the defrosting heater by being bent before the defrosting heater is accommodated and by returning to an initial position after the defrosting heater is accommodated.

The supporting holder may be provided with a heat pipe supporting piece provided at the heat pipe accommodating portion, the heat pipe supporting piece for supporting the heat pipe by being bent before the heat pipe is accommodated and by returning to an initial position after the heat pipe is accommodated.

A collar bent in order to increase a contact area with the defrosting heater or the heat pipe may be formed at one of the defrosting heater accommodating portion and the heat pipe accommodating portion.

The connecting portion may be upward bent from one end of the evaporating portion, and the condensing portion may be bent at an end of the connecting portion.

The condensing portion may be provided with a first condensing portion and a second condensing portion spaced apart from each other in upper and lower directions.

The connecting portion may include a first connecting portion bent from the evaporating portion and configured to connect the evaporating portion with the first condensing portion, and a second connecting portion bent from the first condensing portion and connected to the second condensing portion.

The connecting portion may be provided with a first connecting portion and a second connecting portion upward bent from two ends of the evaporating portion, and the condensing portion may be provided with a first condensing portion and a second condensing portion bent from ends of the first connecting portion and the second connecting portion.

The condensing portion may be provided with a first condensing portion, a second condensing portion and a third condensing portion spaced apart from each other in upper and lower directions.

The connecting portion may be provided with a first connecting portion and a second connecting portion upward bent from two ends of the evaporating portion, and a third connecting portion bent from the second condensing portion and connected to the third condensing portion.

The evaporator may include: a refrigerant pipe having a plurality of horizontal sections spaced apart from each other in upper and lower directions; and a plurality of cooling fins coupled to the horizontal sections.

A heat pipe supporting portion for partially accommodating and supporting the heat pipe may be provided at the cooling fins.

Advantageous Effects

As aforementioned, in an embodiment of the present invention, due to the heat pipe for transferring heat of the defrosting heater to an upper region of the evaporator, a defrosting time may be shortened and power consumption may be reduced.

Further, due to the supporting holder for supporting the defrosting heater and the heat pipe in a spaced manner by a preset interval, damage of the defrosting heater and/or the heat pipe due to their close arrangement may be prevented. Further, since the defrosting heater and the heat pipe are supported in a state that a preset interval therebetween is maintained, heat of the defrosting heater may be smoothly transferred to the heat pipe.

Further, since a welding process of a sealing container (container) of the heat pipe is excluded, leakage of operation fluid through a welding portion may be prevented. This may prolong the lifespan and enhance reliability.

Further, since a structure to fix and support the heat pipe and the defrosting heater is provided at the supporting holder, the heat pipe and the defrosting heater may be coupled to the supporting holder rapidly and easily.

Further, since the connecting portion of the heat pipe is disposed outside a refrigerant pipe holder of the evaporator, the heat pipe may be easily installed without lowering heat exchange efficiency of the evaporator.

BEST MODE

Hereinafter, embodiments of the present invention will be explained in more detail with reference to the attached drawings.

Figure 1:
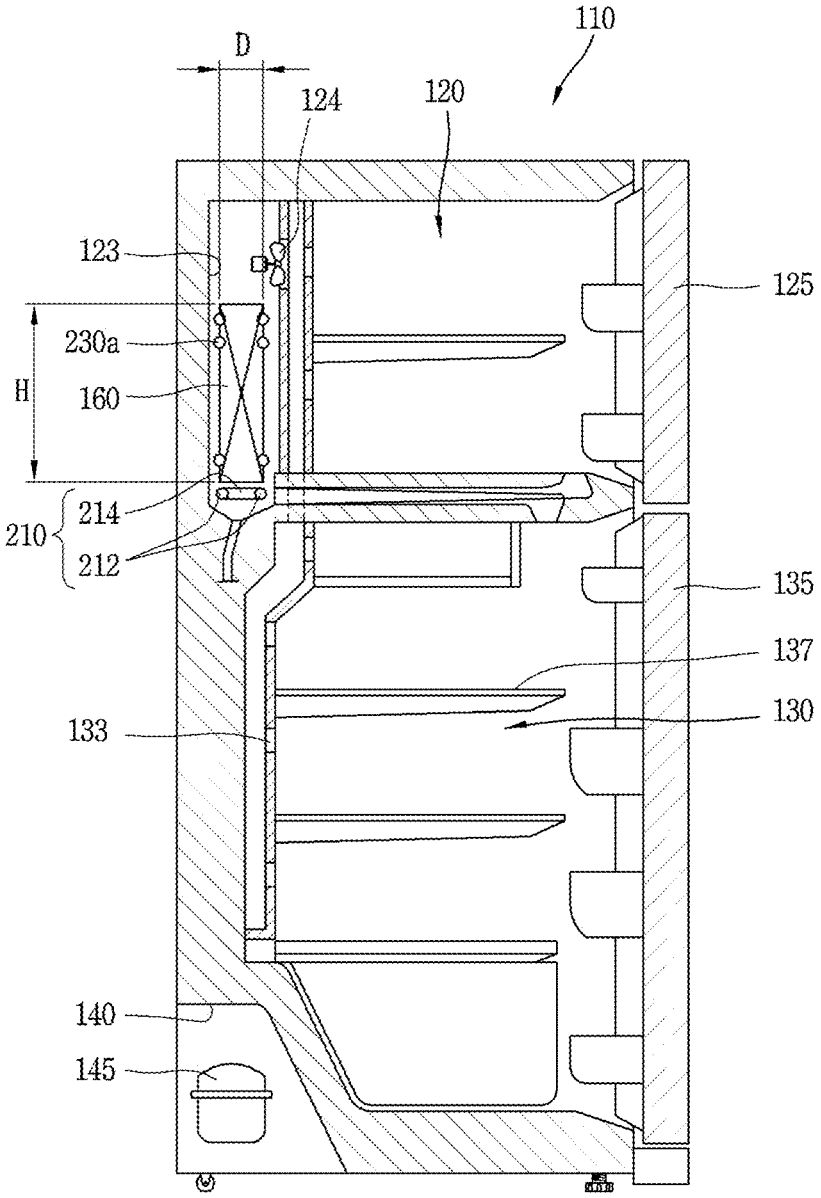
FIG. 1 is a sectional view of a refrigerator having a defrosting device according to an embodiment of the present invention.

As shown in FIG. 1, a refrigerator having a defrosting device according to an embodiment of the present invention includes a refrigerator main body 110; an evaporator 160 provided at the refrigerator main body 110; a defrosting heater 210 provided below the evaporator 160 so as to emit heat when a power is applied thereto; and a heat pipe 230*a* having one side arranged at the defrosting heater 210 so as to transfer heat, having another side upward extending in upper and lower directions of the evaporator 160, and configured to transfer heat to the evaporator 160.

The refrigerator main body 110 may be provided with a freezing chamber 120 and a refrigerating chamber 130, for instance.

The refrigerator main body 110 may be provided with the freezing chamber 120 at an upper side thereof, and may be provided with the refrigerating chamber 130 at a lower side thereof, for instance.

A plurality of shelves 137 may be provided in the refrigerating chamber 130.

In this embodiment, illustrated is a so-called 'top mount refrigerator' where the freezing chamber 120 is provided at an upper side of the refrigerator main body 110, and the refrigerating chamber 130 is provided at a lower side of the refrigerator main body 110. However, a so-called 'bottom freezer refrigerator' where a refrigerating chamber is provided at an upper side and a freezing chamber is provided at a lower side, may be also configured. Alternatively, the refrigerator main body 110 may be also configured as a so-called 'side by side refrigerator' where a refrigerating chamber and a freezing chamber are arranged right and left.

A freezing chamber door 125 configured to open and close the freezing chamber 120 may be provided at the refrigerator main body 110.

A refrigerating chamber door 135 configured to open and close the refrigerating chamber 130 may be provided at the refrigerator main body 110.

For instance, a mechanical chamber 140 may be provided at a rear lower side of the refrigerator main body 110.

A compressor 145 configured to compress a refrigerant of a refrigerating cycle apparatus may be provided in the mechanical chamber 140, for instance.

For instance, a circulation passage 123 along which air inside the freezing chamber 120 circulates may be formed at a rear region of the freezing chamber 120.

A fan 125 configured to accelerate a flow of air may be provided at the circulation passage 123.

For instance, an evaporator 160 configured to heat-exchange circulating air may be provided at the circulation passage 123.

For instance, a defrosting heater 210 which emits heat when a power is applied thereto may be provided below the evaporator 160.

For instance, a cold air outlet 133, through which cold air cooled by the evaporator 160 is discharged, may be formed at a rear region of the refrigerating chamber 130.

Figure 2:
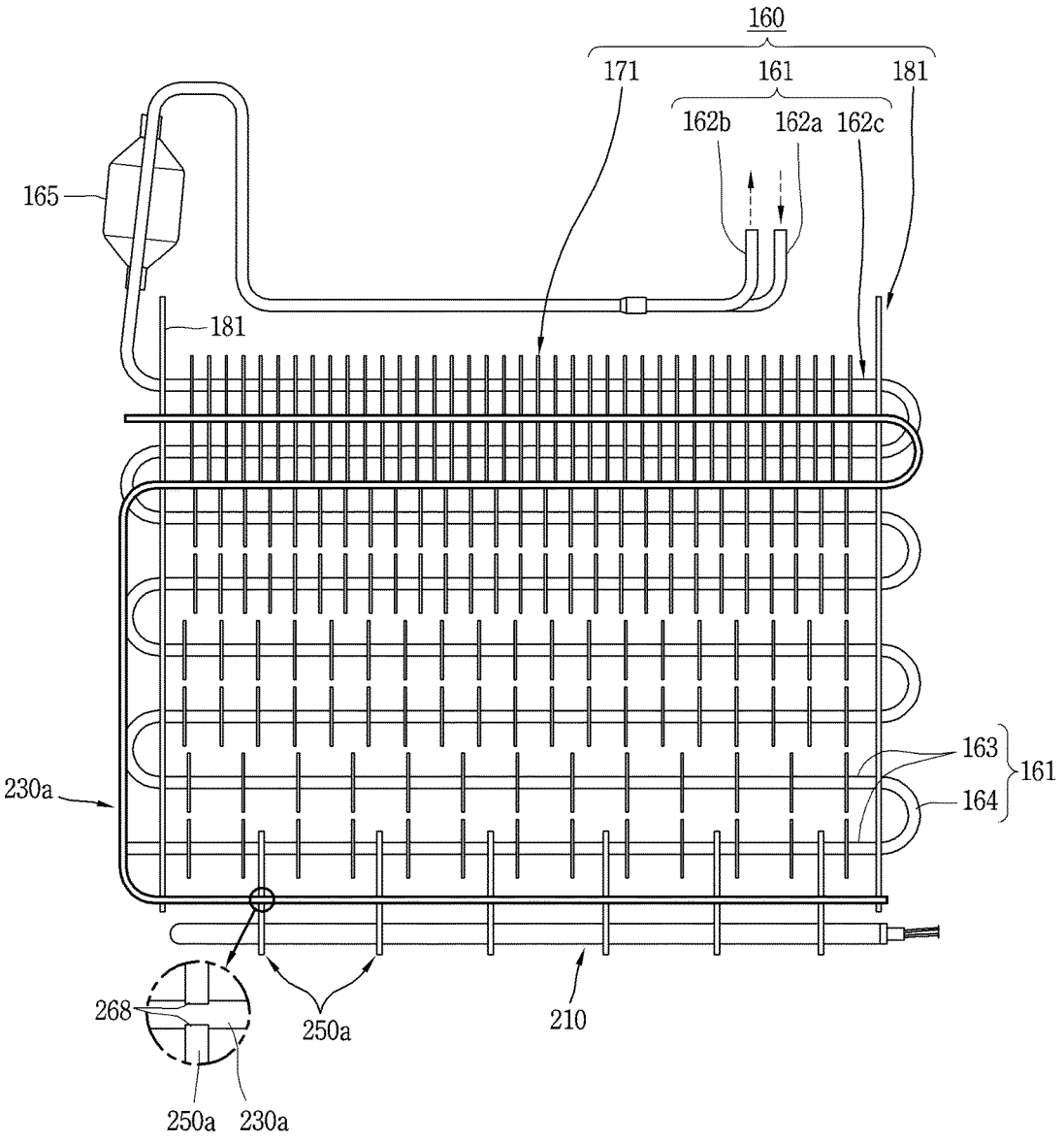
FIG. 2 is a frontal view of the defrosting device of FIG. 1.
Figure 3:
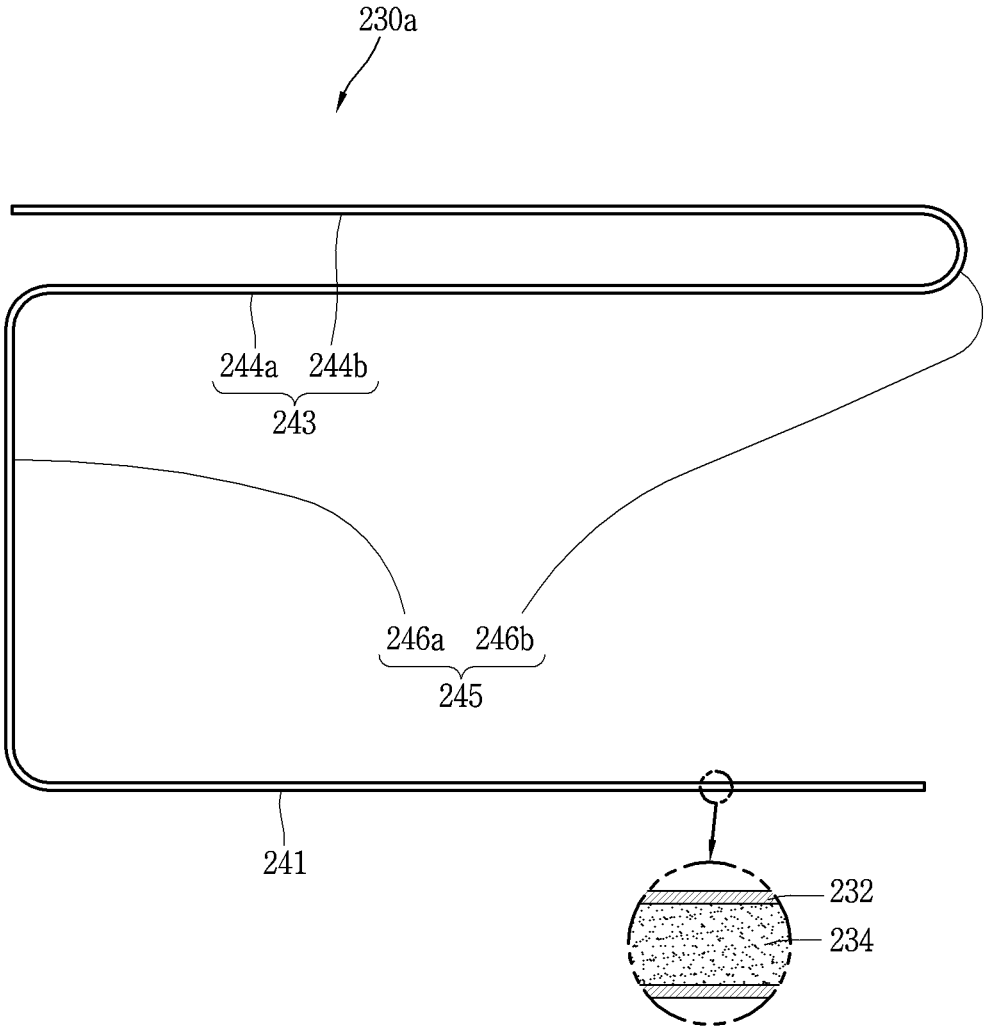
FIG. 3 is a frontal view of a heat pipe of FIG. 2.

The evaporator 160 may have a rectangular cross-sectional shape with a height H and a thickness D as shown in FIG. 1. For instance, as shown in FIG. 2, the evaporator 160 may include a refrigerant pipe 161 which forms a refrigerant passage, and cooling fins 171 coupled to the refrigerant pipe 161.

For instance, the refrigerant pipe 161 may be formed as a pipe having a long length is bent a plurality of times.

The refrigerant pipe 161 may include an inflow section 162*a*, an outflow section 162*b*, and a heat exchange section 162*c*.

For instance, the refrigerant pipe 161 (substantially, the heat exchange section 162*c*) may be bent with horizontal sections 163 spaced apart from each other in parallel, and with a connecting sections 164 which connects the horizontal sections 163 to each other.

For instance, the refrigerant pipe 161 may be provided with 8 horizontal sections 163 spaced apart from each other to form lines in upper and lower directions.

The refrigerant pipe 161 may be provided with the horizontal sections 163 spaced apart from each other to have two lines in a widthwise direction (right and left directions).

For instance, the refrigerant pipe 161 may be provided with 16 horizontal sections 163 spaced apart from each other to have 8 lines in upper and lower directions and to have 2 lines in right and left directions.

In this embodiment, the refrigerant pipe 161 is formed to have two lines, and each line is provided with 8 horizontal sections 163. However, the number of the lines and the number of the horizontal sections 163 of the refrigerant pipe 161 may be properly controlled.

For instance, the evaporator 160 may be disposed in upper and lower directions of the refrigerator main body 110.

For instance, the evaporator 160 may be installed such that air may be introduced from a lower side and may be discharged to an upper side. For instance, the cooling fins 171 may be disposed at each of the horizontal sections 163 of the refrigerant pipe 161, such that a pitch of a downstream side may be narrower than a pitch of an upstream side in a flow direction of air.

For instance, an accumulator 165 may be provided at the inflow section 162*a* of the refrigerant pipe 161.

Tube holders or refrigerant pipe holders 181 (hereinafter, will be represented as 'refrigerant pipe holders 181') configured to support the refrigerant pipe 161 may be provided at both sides of the evaporator 160.

The refrigerant pipe holder 181 may have a rectangular plate shape, for instance.

The refrigerant pipe holder 181 may be formed to have a length greater than a width, for instance.

The defrosting heater 210 may be provided below the evaporator 160.

For instance, the defrosting heater 210 may be configured as an electric heater which emits heat by an electric resistance when a power is applied thereto.

The defrosting heater 210 may be configured as a so-called pipe heater or sheath heater, for instance.

An outer tube (protection tube) of the defrosting heater 210 may be formed of a stainless material, for instance.

The defrosting heater 210 may be formed to have a 'U'-shape, for instance.

For instance, the defrosting heater 210 may be provided with straight heat emitting sections 212 spaced apart from each other in a horizontal direction, and a curved (e.g., 'U'-shaped) connecting section 214 for connecting the straight heat emitting sections 212 with each other (refer to FIG. 1).

A heat pipe 230*a* for upward transferring heat of the defrosting heater 210 may be provided at the evaporator 160.

For instance, the heat pipe 230*a* may be configured to transfer heat to the evaporator 160, by having one side arranged at one side of the defrosting heater 210 so as to transfer heat, and by having another side upward extending in upper and lower directions of the evaporator 160.

For instance, the heat pipe 230*a* may include a sealing container (container) 232, and operation fluid 234 provided in the sealing container and capable of having a phase change (being evaporated).

With such a configuration, as heat of the defrosting heater 210 is rapidly transferred to an upper side of the evaporator 160 (e.g., more rapid than copper (Cu) about 40 times, and more rapid than aluminum (Al) about 80 times), upper and lower sides of the evaporator 160 may be simultaneously defrosted.

Accordingly, a defrosting time of the evaporator 160 may be shortened.

Further, since an electric heater using a power is not used at an upper region of the evaporator 160, power consumption may be reduced when the evaporator 160 is defrosted.

For instance, the sealing container 232 may be formed of a copper (Cu) pipe.

For instance, the sealing container 232 may be formed of an aluminum (Al) pipe.

For instance, the operation fluid 234 may be formed as a refrigerant.

For instance, the operation fluid 234 may be formed as a hydrofluorocarbon (HFC) refrigerant.

For instance, the operation fluid 234 may be formed as R134a.

For instance, the heat pipe 230*a* may include a heat absorbing portion or an evaporating portion 241 (hereinafter, will be represented as 'evaporating portion 241') for evaporating the operation fluid 234 through heat absorption, a heat emitting portion or a condensing portion 243 (hereinafter, will be represented as 'condensing portion 243') for condensing the operation fluid 234 through heat emission, and an insulating portion or a connecting portion 245 (hereinafter, will be represented as 'connecting portion 245') for connecting the evaporating portion 241 and the condensing portion 243 to each other.

For instance, the evaporating portion 241 may be disposed above the defrosting heater 210.

For instance, the evaporating portion 241 may be disposed in parallel to the defrosting heater 210.

For instance, the condensing portion 243 may be disposed to be spaced apart from the evaporating portion 241.

For instance, the condensing portion 243 may be disposed above the evaporating portion 241 in a spaced manner.

For instance, the condensing portion 243 may include a first condensing portion 244*a* and a second condensing portion 244*b* spaced apart from each other up and down and parallel to each other.

For instance, the connecting portion 245 may include a first connecting portion 246*a* for connecting the evaporating portion 241 with the first condensing portion 244*a*, and a second connecting portion 246*b* for connecting the first condensing portion 244*a* with the second condensing portion 244*b*.

The connecting portion 245 may be disposed outside the refrigerant pipe holders 181 of the evaporator 160, respectively.

With such a configuration, the cooling fins 171 need not be removed for installation of the connecting portion 245. This may prevent lowering of heat exchange efficiency of the evaporator 160 due to removal of the cooling fins 171.

The heat pipe 230*a* may be formed to be supported in a spaced state from the defrosting heater 210 by a preset interval.

Here, the heat pipe 230*a* and the defrosting heater 210 may be configured to maintain an interval therebetween within a range of 2 mm-15 mm, for instance.

For instance, if an interval between the heat pipe 230*a* and the defrosting heater 210 is less than 2 mm, the heat pipe 230*a* which is relatively weak may have a scratch, a welding, a corrosion, etc. On the other hand, if the interval is more than 15 mm, a heat transfer between the heat pipe 230*a* and the defrosting heater 210 may be degraded.

The heat pipe 230*a* and the defrosting heater 210 may maintain a preset interval therebetween by a supporting holder 250*a*.

The supporting holder 250*a* may be formed as a plate member, for instance.

The supporting holder 250*a* may be configured so as to be coupled to the refrigerant pipe 161 disposed at a lower end of the evaporator 160, for instance.

The supporting holder 250*a* may be formed to have a quadrangular plate shape, for instance.

Figure 4:
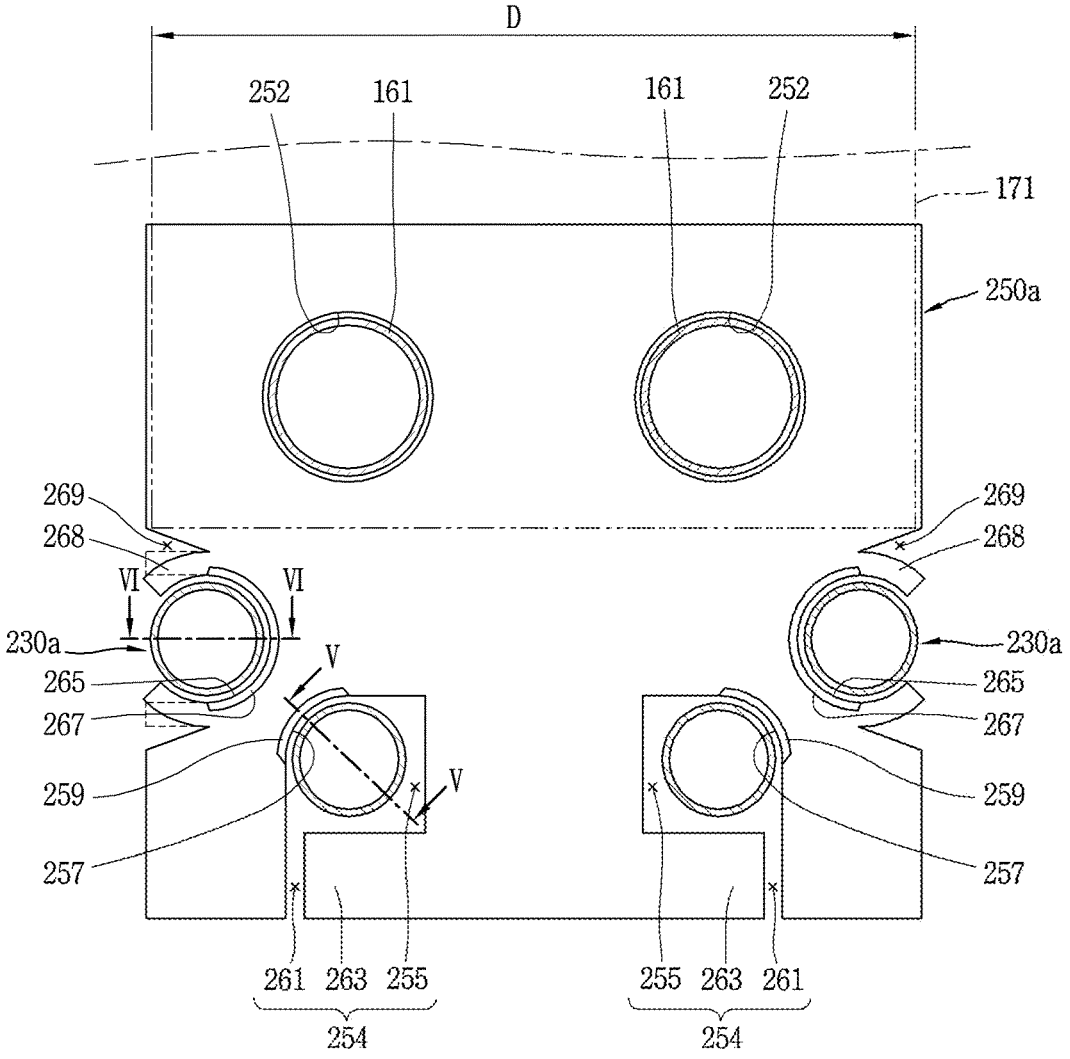
FIG. 4 is a frontal view of a refrigerant pipe holder of FIG. 2.

For instance, as shown in FIG. 4, the supporting holder 250*a* may be provided with refrigerant pipe accommodating portions 252 so as to be coupled to the refrigerant pipe 161 formed below the evaporator 160.

For instance, the refrigerant pipe accommodating portions 252 may be formed at both sides at an upper region of the supporting holder 250*a*.

For instance, the supporting holder 250*a* may be provided with defrosting heater accommodating portions 254 each for accommodating the defrosting heater 210 therein.

For instance, the defrosting heater accommodating portions 254 may be spaced apart from each other at a lower region of the supporting holder 250*a*.

For instance, the defrosting heater accommodating portions 254 may be formed below the refrigerant pipe accommodating portions 252.

For instance, each of the defrosting heater accommodating portions 254 may be configured such that a heat emitting section of the defrosting heater 210 may be inserted from a lower end of the supporting holder 250*a*.

For instance, each of the defrosting heater accommodating portions 254 may include a defrosting heater accommodating space 255 for accommodating the defrosting heater 210 therein, and a cut-out portion 261 downward cut-out from the defrosting heater accommodating space 255.

A defrosting heater supporting piece 263 for supporting the defrosting heater 210 at a lower side may be provided at one side of the cut-out portion 261.

The defrosting heater supporting piece 263 may be cut-out in a direction perpendicular to a plate surface of the supporting holder 250*a*, before the defrosting heater 210 is inserted.

With such a configuration, a size of an entrance of the defrosting heater accommodating space 255 is increased, and the defrosting heater 210 may be easily upward inserted from a lower side of the supporting holder 250*a*.

The defrosting heater supporting piece 263 may return to the initial position after the defrosting heater 210 is accommodated, thereby supporting the accommodated defrosting heater 210 at a lower side.

Figure 5:
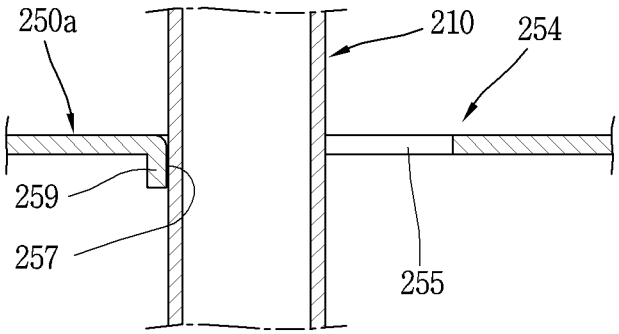
FIG. 5 is a sectional view taken along line 'V-V' in FIG. 4.

For instance, as shown in FIG. 5, the defrosting heater accommodating portion 254 may be provided with a circular arc-shaped portion 257 having a curvature radius corresponding to an outer diameter of the defrosting heater 210, for an increased contact with the defrosting heater 210.

The circular arc-shaped portion 257 of the defrosting heater accommodating portion 254 may be provided with an extending portion or a collar 259 (hereinafter, will be represented as 'collar 259'), for an increased contact area with the defrosting heater 210.

With such a configuration, a heat transfer amount by a heat transfer between the defrosting heater 210 and the supporting holder 250*a* may be increased.

In this embodiment, the defrosting heater accommodating portion 254 is formed to have an approximate rectangular shape. However, the defrosting heater accommodating portion 254 may be formed to have a circular shape or a circular arc shape.

A heat pipe accommodating portion 265 for accommodating the heat pipe 230*a* therein may be formed at the supporting holder 250*a*.

For instance, the heat pipe accommodating portion 265 may be formed above the defrosting heater accommodating portion 254.

For instance, the heat pipe accommodating portion 265 may be formed above the defrosting heater accommodating portion 254, in an outward spaced manner.

For instance, the heat pipe accommodating portion 265 may be formed so as to be spaced from the defrosting heater accommodating portion 254, in a diagonal direction.

For instance, the heat pipe accommodating portion 265 may be formed to be open towards a side of the supporting holder 250*a*.

For instance, the heat pipe accommodating portion 265 may be formed to have a circular arc shape.

Figure 6:
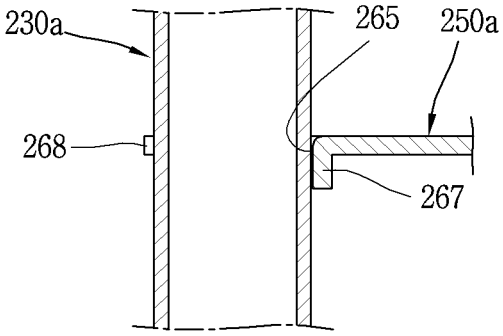
FIG. 6 is a sectional view taken along line 'VI-VI' in FIG. 4.

For instance, as shown in FIG. 6, the heat pipe accommodating portion 265 may be provided with a collar 267 bent for an increased contact area between the heat pipe 230*a* and the supporting holder 250*a*.

For instance, the supporting holder 250*a* may be provided with heat pipe fixing pieces 268 for fixing the heat pipe 230*a* by being bent in order to prevent separation of the heat pipe 230*a* accommodated in the heat pipe accommodating portion 265.

For instance, the heat pipe fixing pieces 268 may be provided at both sides of an entrance of the heat pipe accommodating portion 265.

For instance, the heat pipe fixing pieces 268 may be formed to have a preset width.

For instance, a cut-out portion 269, cut-out in order to easily bend the heat pipe fixing piece 268, may be formed at one side of each of the heat pipe fixing pieces 268.

Figure 7:
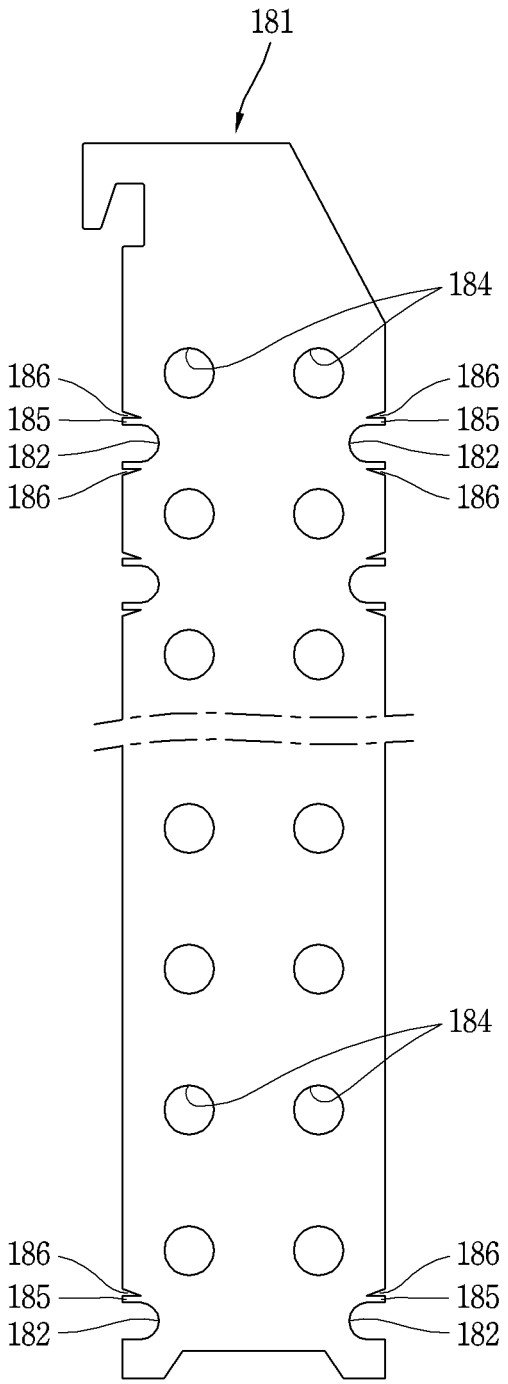
FIG. 7 is a frontal view of a refrigerant pipe holder of FIG. 2.

For instance, as shown in FIG. 7, a heat pipe accommodating portion 182 for accommodating the heat pipe 230*a* therein may be formed at the refrigerant pipe holder 181.

A refrigerant pipe accommodating portions 184 for coupling the refrigerant pipe 161 thereto may be penetratingly-formed at a central region of the refrigerant pipe holder 181.

The heat pipe accommodating portions 182 may be formed at both sides of the refrigerant pipe holder 181.

For instance, each of the heat pipe accommodating portions 182 of the refrigerant pipe holder 181 may be formed to be open in a lateral direction.

Each of the heat pipe accommodating portions 182 may be formed to accommodate therein the evaporating portion 241 and the condensing portion 243 of the heat pipe 230*a*.

For instance, each of the heat pipe accommodating portions 182 of the refrigerant pipe holder 181 may be provided with a heat pipe fixing piece 185 for fixing the heat pipe 230*a* by being bent after the heat pipe 230*a* is accommodated.

A cut-out portion 186, cut-out in order to easily bend the heat pipe fixing piece 185, may be formed at one side of each of the heat pipe fixing pieces 185.

Figure 8:
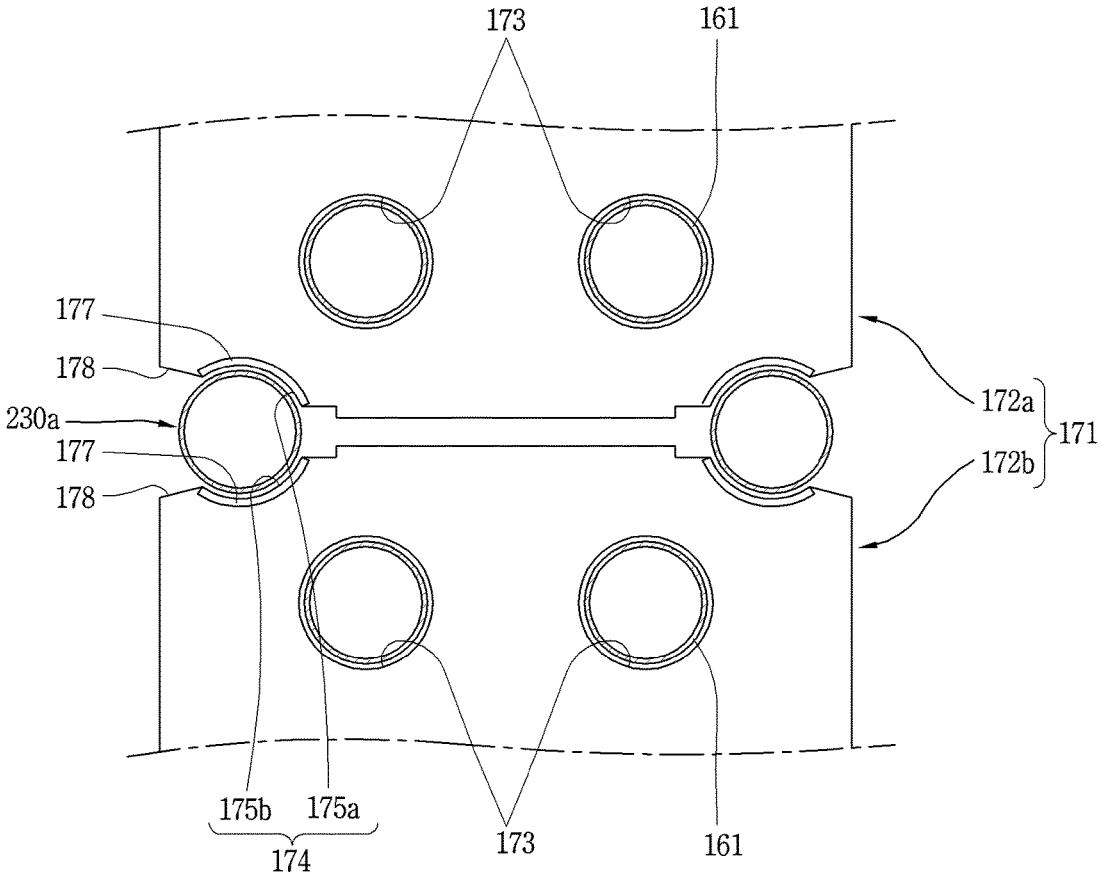
FIG. 8 is a view showing a heat pipe supporting portion of cooling fins of FIG. 2.

For instance, as shown in FIG. 8, a heat pipe supporting portion 174 for inserting and supporting the heat pipe 230*a* (the condensing portion 243) may be formed at an upper region of the evaporator 160.

For instance, the heat pipe supporting portion 174 may be formed at the cooling fins 171.

For instance, the heat pipe supporting portion 174 may be formed between two cooling fins 172*a*, 172*b* disposed up and down.

For instance, the heat pipe supporting portion 174 may be provided with an upper supporting portion 175*a* formed at the upper cooling fin 172*a*, and a lower supporting portion 175*b* formed at the lower cooling fin 172*b*.

A guiding inclined portion 177 inward inclined so as to guide insertion of the heat pipe 230*a* may be formed at each of entrances of the heat pipe supporting portion 174.

For instance, a collar 178 for an increased contact area with the heat pipe 230*a* may be formed at each heat pipe supporting portion 174.

With such a configuration, a heat transfer amount of the heat pipe 230*a* and the cooling fins 171 may be increased.

With such a configuration, each of the supporting holders 250*a* may be coupled to the refrigerant pipe 161 disposed at a lowermost side of the evaporator 160, with a preset interval.

The heat pipe 230*a* (the evaporating portion 241) may be coupled to the heat pipe accommodating portion 265 of each of the supporting holders 250*a*.

After the heat pipe 230*a* is coupled, the heat pipe fixing piece 268 may be bent so as to contact an outer surface of the heat pipe 230*a*.

With such a configuration, the heat pipe 230*a* may be prevented from being separated from the heat pipe accommodating portion 265.

The condensing portion 243 (upper side) of the heat pipe 230*a* may be inserted to be supported in the heat pipe supporting portion 174 formed between the cooling fins 171.

The defrosting heater supporting piece 263 of the defrosting heater accommodating portion 254 of each of the supporting holders 250*a* may be bent in a direction perpendicular to a plate surface of the supporting holder 250*a*.

Once the defrosting heater 210 is accommodated in the defrosting heater accommodating portion 254, each of the defrosting heater supporting pieces 263 returns to the initial position to contact a lower part of the defrosting heater 210, thereby supporting the defrosting heater 210.

Once a cooling operation is started, air of the freezing chamber 120 and/or the refrigerating chamber 130 may be introduced into the circulation passage 123.

The air introduced into the circulation passage 123 may be cooled while passing through the evaporator 160.

The air cooled while passing through the evaporator 160 may be provided to the freezing chamber 120 and/or the refrigerating chamber 130, thereby cooling the freezing chamber 120 and/or the refrigerating chamber 130.

Once a defrosting operation is started, the defrosting heater 210 may have a temperature increase as a power is supplied to the defrosting heater 210.

With such a configuration, heat of the defrosting heater 210 may be diffused to the periphery, thereby being used to remove frost on a lower region of the evaporator 160.

Once a power is supplied to the defrosting heater 210, heat generated from the defrosting heater 210 may be transferred to the heat pipe 230*a* by conduction, convection and radiation.

With such a configuration, the operation fluid 234 inside the evaporating portion 241 of the heat pipe 230*a* may be evaporated by absorbing peripheral heat.

The evaporated operation fluid 234 of the heat pipe 230*a* may move to the condensing portion 243 of the heat pipe 230*a*.

Then, the operation fluid 234 which has moved to the condensing portion 243 of the heat pipe 230*a* may emit heat to the periphery.

With such a configuration, frost on an upper region of the evaporator 160 may be removed.

The operation fluid 234 inside the condensing portion 243 may be condensed through a heat emission, and the condensed operation fluid 234 may downward flow to the evaporating portion 241.

As aforementioned, a heat transfer of the heat pipe 230*a* is performed more rapidly than in copper and aluminum, by several tens of times. Accordingly, heat of the defrosting heater 210 may be rapidly transferred to an upper region of the evaporator 160.

A lower region and an upper region of the evaporator 160 may be defrosted almost simultaneously.

With such a configuration, power consumption for defrosting may be significantly reduced, and a defrosting time of the evaporator 160 may be significantly shortened.

Hereinafter, a modification example of the supporting holder will be explained with reference to FIGS. 9 and 10.

Components the same as or similar to the aforementioned components will not be explained, and will be provided with the same reference numerals, for convenience.

Further, the same explanation about a configuration may be omitted.

Figure 9:
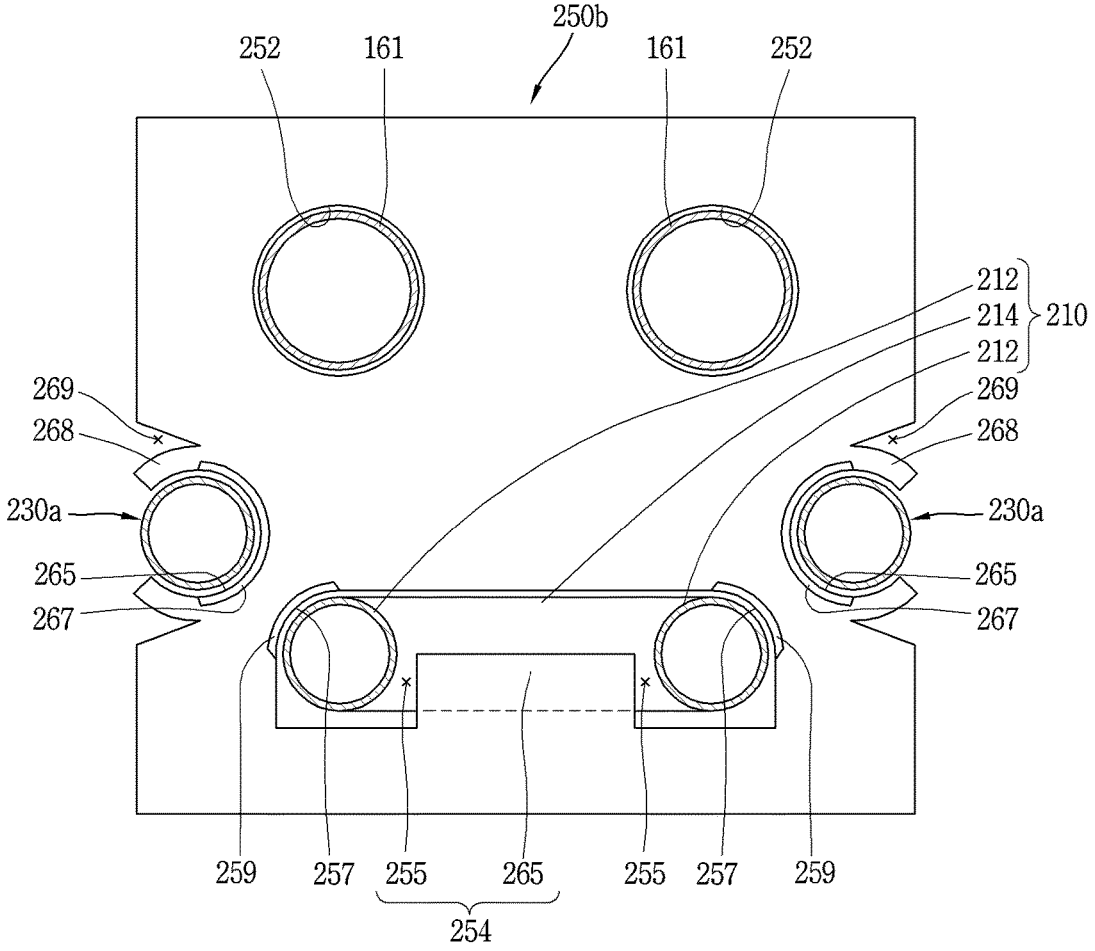
FIG. 9 is a modification example of a supporting holder of FIG. 2.

For instance, as shown in FIG. 9, a supporting holder 250*b* may be provided with a defrosting heater accommodating portion 254 penetratingly formed so as to couple the defrosting heater 210 thereto, in a lengthwise direction of horizontal sections of the refrigerant pipe 161.

The defrosting heater accommodating portion 254 of the supporting holder 250*b* may be provided with a circular arc-shaped portion 257 at one region thereof, for instance.

For instance, the circular arc-shaped portion 257 may be formed at a region close to the heat pipe accommodating portion 265.

For instance, a collar 259 bent in order to increase a contact area with the defrosting heater 210 may be formed at the defrosting heater accommodating portion 254.

For instance, the collar 259 of the defrosting heater accommodating portion 254 may be formed around the circular arc-shaped portion 257.

For instance, the defrosting heater accommodating portion 254 may be provided with a defrosting heater accommodating space 255 for accommodating therein each of heat emitting sections 212 of the defrosting heater 210.

For instance, the defrosting heater accommodating spaces 255 may be formed to communicate with each other.

For instance, the defrosting heater accommodating portion 254 may be provided with a defrosting heater supporting piece 263 provided at a central region of the defrosting heater accommodating spaces 255, the defrosting heater supporting piece 263 configured to support the defrosting heater 210 by being bent when the defrosting heater 210 is inserted and by returning to the initial position after the defrosting heater 210 is accommodated.

With such a configuration, in case of coupling the defrosting heater 210 into the defrosting heater accommodating portion 254 of the supporting holder 250*b*, the defrosting heater supporting piece 263 may be bent in a direction perpendicular to a plate surface of the supporting holder 250*b*.

With such a configuration, the connecting section 214 of the defrosting heater 210 may be easily inserted into the defrosting heater accommodating spaces 255.

The defrosting heater supporting piece 263 may return to the initial position after the defrosting heater 210 is accommodated.

With such a configuration, a gap of the defrosting heater 210 in a horizontal direction may be prevented.

Figure 10:
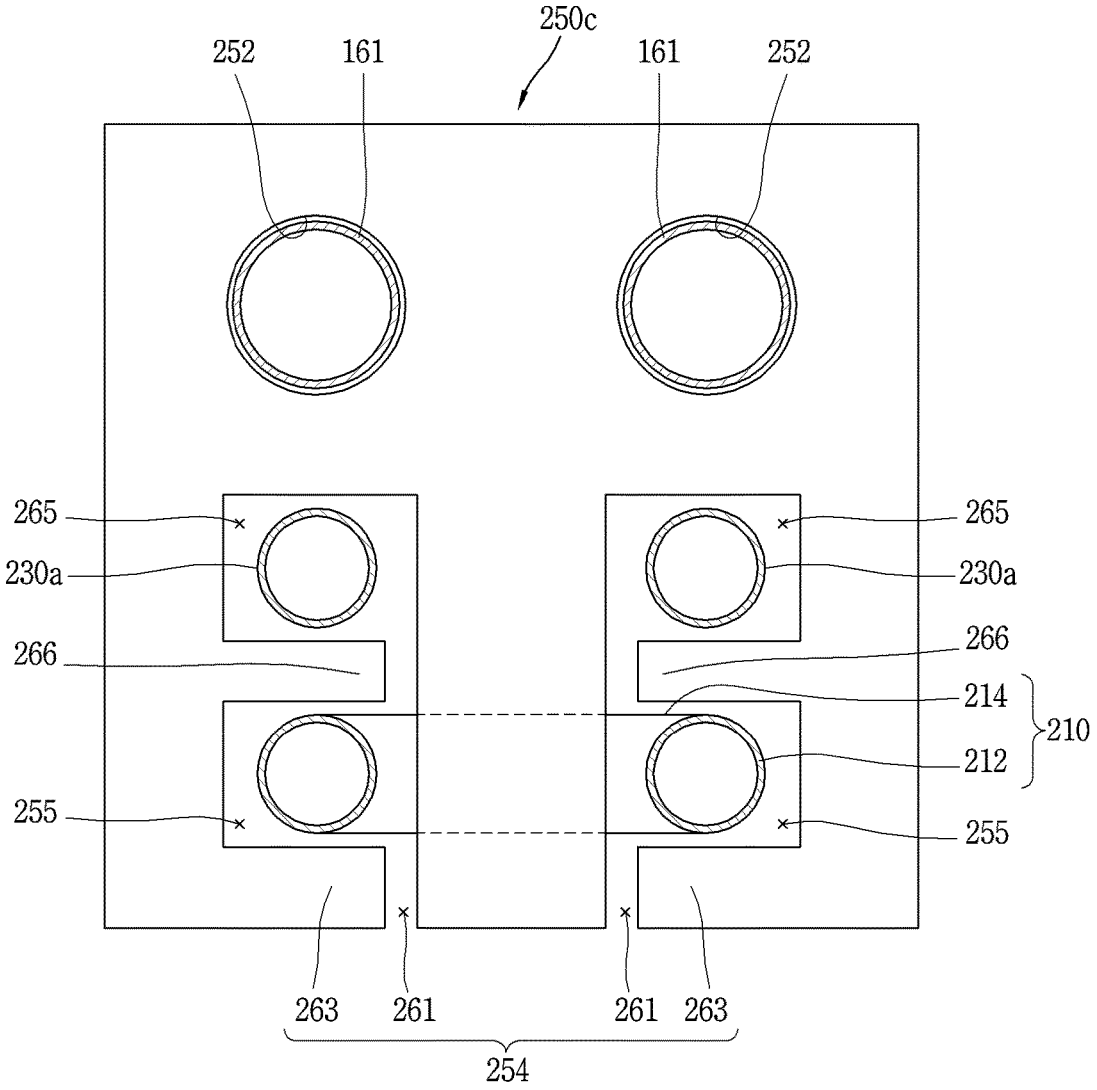
FIG. 10 is another modification example of the supporting holder of FIG. 2.

For instance, as shown in FIG. 10, a supporting holder 250*c* may be provided with a heat pipe accommodating portion 265 and a defrosting heater accommodating portion 254 which communicate with each other.

With such a configuration, the heat pipe 230*a* and the defrosting heater 210 may be coupled rapidly and easily.

For instance, the heat pipe accommodating portion 265 may be configured to insert the heat pipe 230*a* therein from a lower side of the supporting holder 250*c*.

For instance, the defrosting heater accommodating portion 254 may be configured to insert the defrosting heater 210 therein from a lower side of the supporting holder 250*c*.

For instance, the heat pipe accommodating portion 265 may be provided with a heat pipe supporting piece 266 for supporting the heat pipe 230*a* by being bent in a direction perpendicular to a plate surface of the supporting holder 250*c* before the heat pipe 230*a* is inserted and by returning to the initial position after the heat pipe 230*a* is inserted.

For instance, the defrosting heater accommodating portion 254 may be provided with a defrosting heater supporting piece 263 for supporting the defrosting heater 210 by being bent in a direction perpendicular to the plate surface of the supporting holder 250*c* before the defrosting heater 210 is inserted and by returning to the initial position after the defrosting heater 210 is inserted.

In this embodiment, the heat pipe supporting piece 266 and the defrosting heater supporting piece 263 may be bent in a direction perpendicular to the plate surface of the supporting holder 250*c*, before the heat pipe 230*a* and the defrosting heater 210 are inserted, respectively, thereby opening entrances.

With such a configuration, the heat pipe supporting piece 266 and the defrosting heater supporting piece 263 may be bent in a direction perpendicular to the plate surface of the supporting holder 250*c*, before the heat pipe 230*a* and the defrosting heater 210 are inserted, respectively.

With such a configuration, an entrance (common entrance) of the heat pipe accommodating portion 265 and the defrosting heater accommodating portion 254 may be open.

Then, the heat pipe 230*a* may be inserted into the heat pipe accommodating portion 265 through the defrosting heater accommodating portion 254.

And the heat pipe supporting piece 266 may return to the initial position, thereby supporting the heat pipe 230*a* at a lower side.

Once the heat pipe supporting piece 266 is bent to the initial position, the defrosting heater 210 may be inserted into the defrosting heater accommodating portion 254.

Once the defrosting heater 210 is accommodated, the defrosting heater supporting piece 263 may return to the initial position to support the defrosting heater 210 at a lower side.

Hereinafter, a modification example of the heat pipe will be explained with reference to FIGS. 11 to 14.

Figure 11:
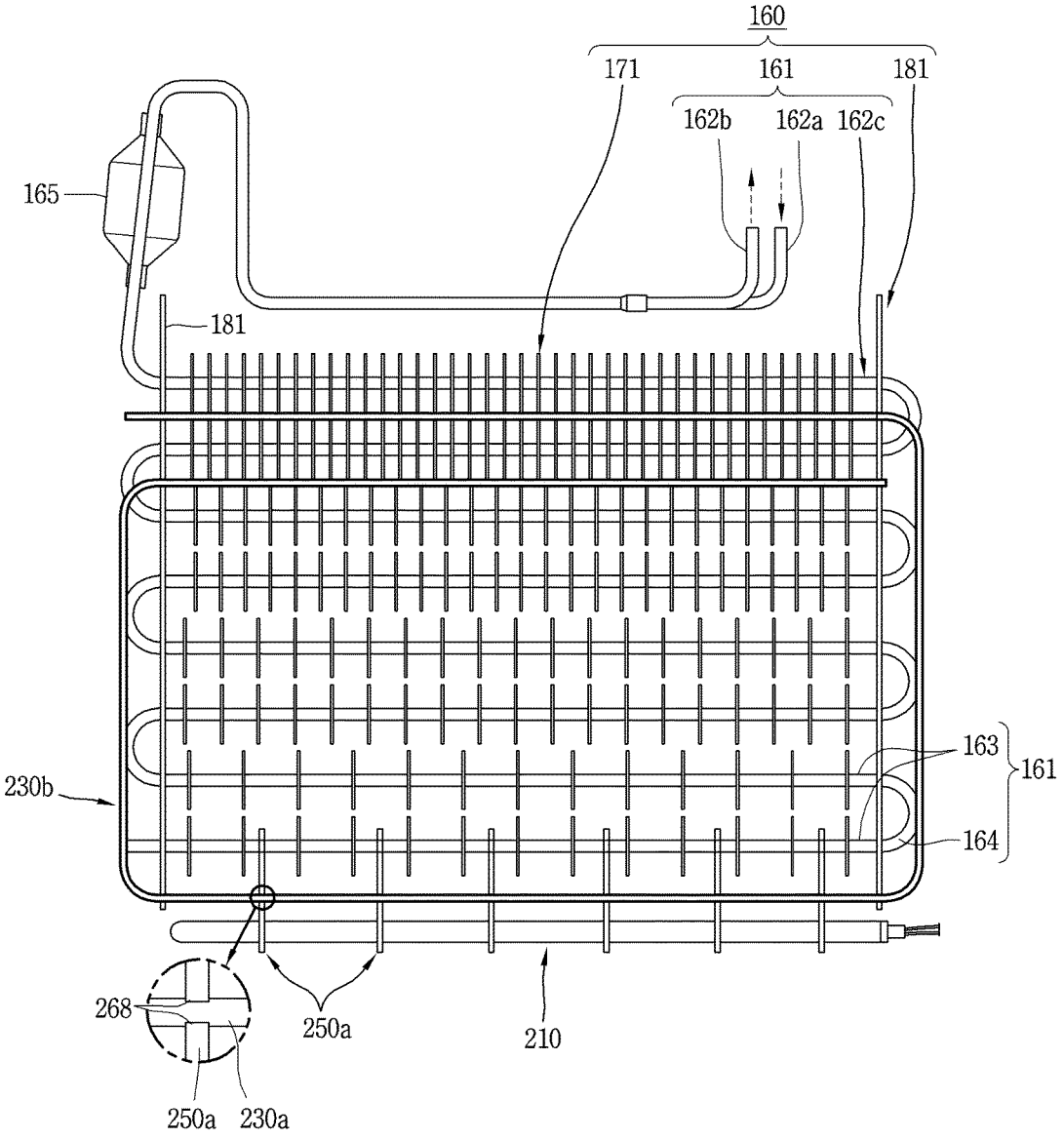
FIG. 11 is a modification example of the heat pipe of FIG. 2.
Figure 12:
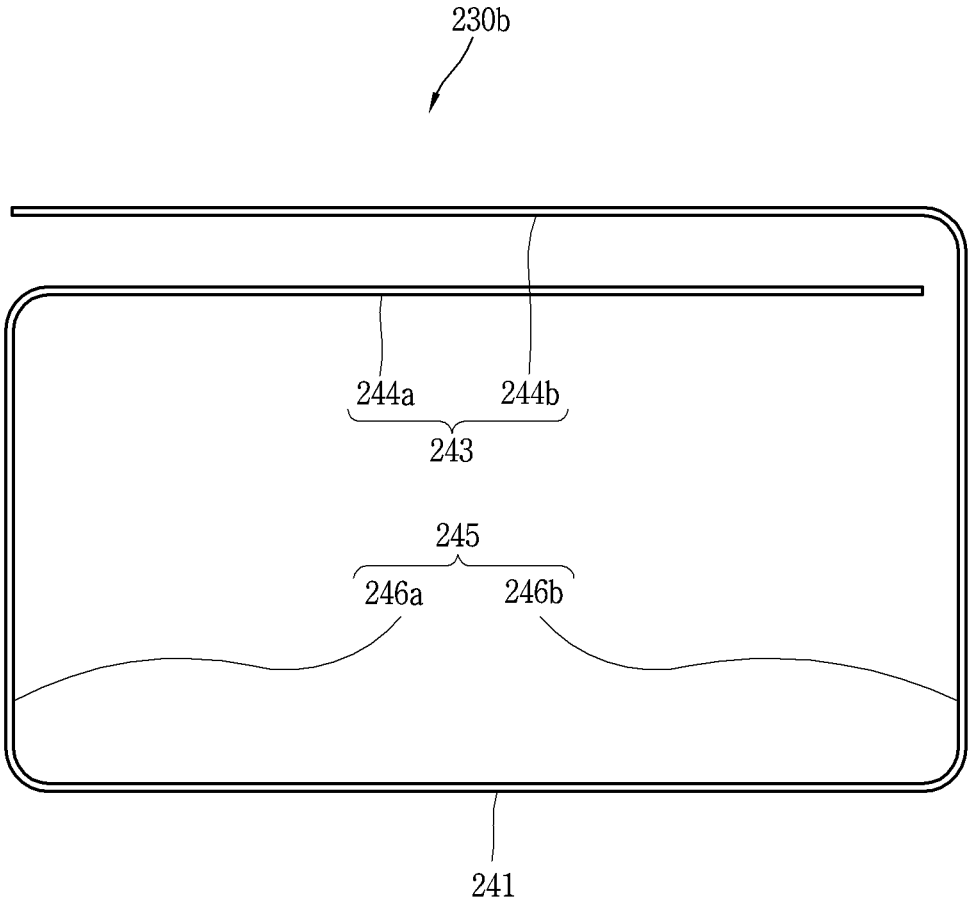
FIG. 12 is a frontal view of the heat pipe of FIG. 11.

As shown in FIGS. 11 and 12, a heat pipe 230*b* may include an evaporating portion 241 provided at one side of the defrosting heater 210, a condensing portion 243 spaced apart from the evaporating portion 241, and a connecting portion 245 for connecting the evaporating portion 241 and the condensing portion 243 with each other.

For instance, the condensing portion 243 may include a first condensing portion 244*a* disposed above the evaporating portion 241, and a second condensing portion 244*b* disposed above the first condensing portion 244*a*.

For instance, the connecting portion 245 of the heat pipe 230*b* may include a first connecting portion 246*a* for connecting the evaporating portion 241 with the first condensing portion 244*a*, and a second connecting portion 246*b* for connecting the evaporating portion 241 with the second condensing portion 244*b*.

The first connecting portion 246*a* may be upward bent from one end of the evaporating portion 241, and the second connecting portion 246*b* may be upward bent from another end of the evaporating portion 241.

With such a configuration, in the heat pipe 230*b*, a part of the operation fluid 234 evaporated from the evaporating portion 241 may move to the first condensing portion 244*a* through the first connecting portion 246*a*.

Another part of the operation fluid 234 evaporated from the evaporating portion 241 may move to the second condensing portion 244*b* through the second connecting portion 246*b*. Accordingly, the operation fluid 234 may upward move more rapidly.

Further, in the heat pipe 230*b*, the operation fluid 234 condensed by the first condensing portion 244*a* moves to the evaporating portion 241 through the first connecting portion 246*a*, and the operation fluid 234 condensed by the second condensing portion 244*b* moves to the evaporating portion 241 through the second connecting portion 246*b*. Accordingly, the operation fluid 234 may downward move more rapidly.

With such a configuration, in the heat pipe 230*b*, since heat of the defrosting heater 210 is rapidly transferred to an upper region of the evaporator 160, defrosting the upper region of the evaporator 160 may be accelerated.

In the heat pipe 230*b*, the operation fluid 234 condensed by the first condensing portion 244*a* and the second condensing portion 244*b* moves to the evaporator 241 through the first connecting portion 246*a* and the second connecting portion 246*b*, respectively. Accordingly, a downward movement of the operation fluid 234 may be accelerated.

With such a configuration, a heat transfer between the defrosting heater 210 and the heat pipe 230*b* may be accelerated, and defrosting the upper region of the evaporator 160 may be accelerated.

Figure 13:
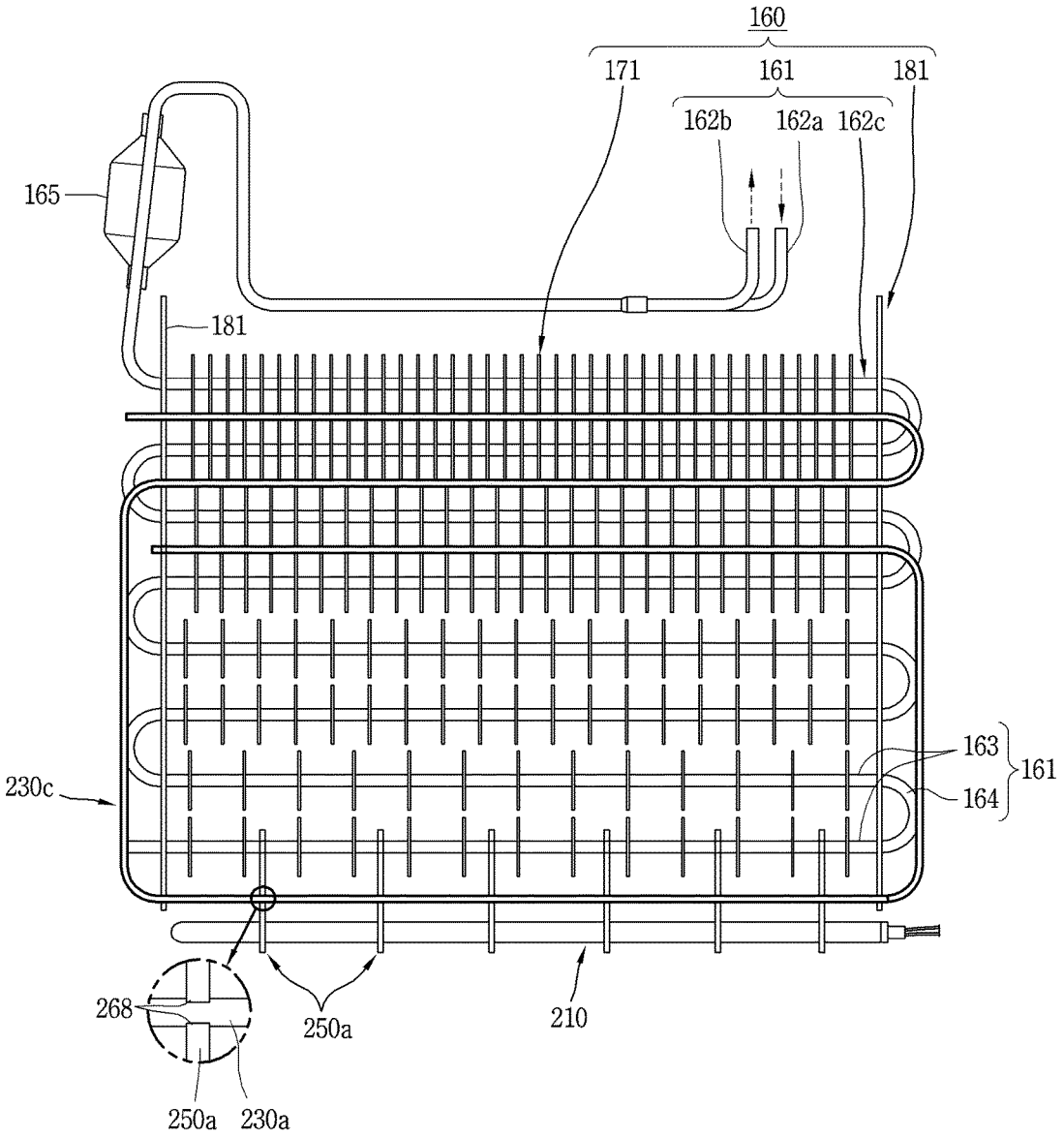
FIG. 13 is another modification example of the heat pipe of FIG. 2.
Figure 14:
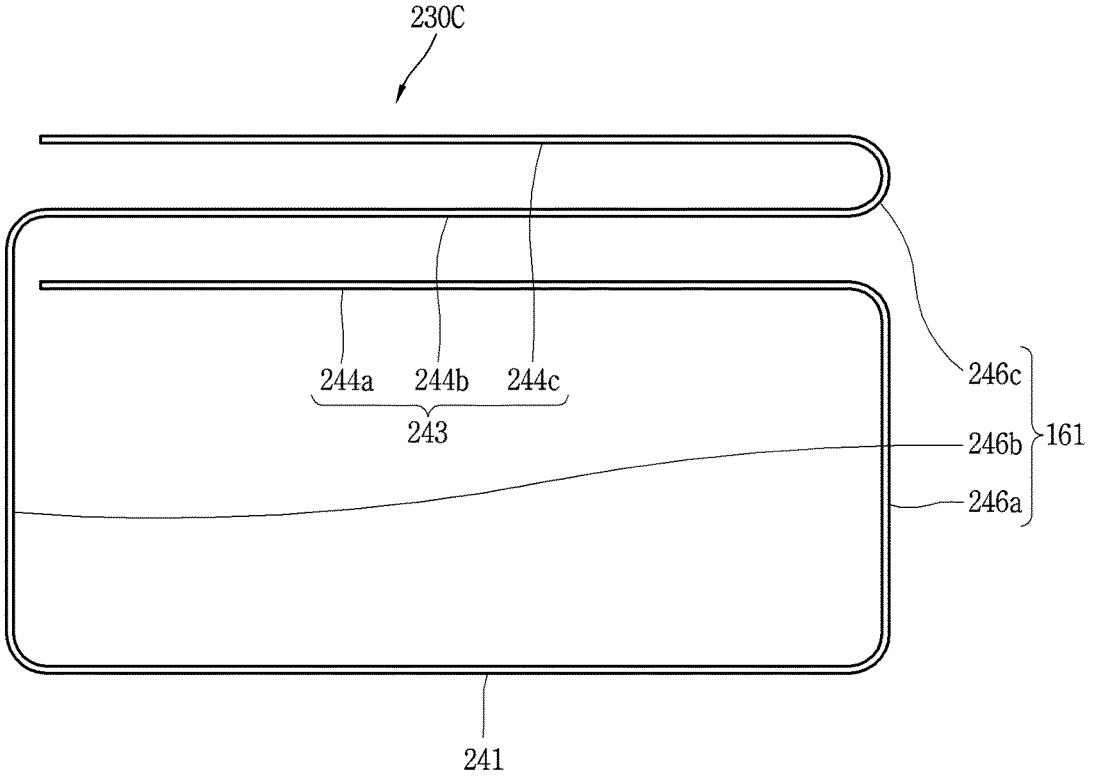
FIG. 14 is a frontal view of the heat pipe of FIG. 13.

As shown in FIGS. 13 and 14, a heat pipe 230*c* may include an evaporating portion 241 provided at one side of the defrosting heater 210, a condensing portion 243 disposed above the evaporator 241 in a spaced manner, and a connecting portion 245 for connecting the evaporating portion 241 and the condensing portion 243 with each other.

For instance, the condensing portion 243 may include a first condensing portion 244*a* disposed above the evaporating portion 241, a second condensing portion 244*b* disposed above the first condensing portion 244*a*, and a third condensing portion 244*c* disposed above the second condensing portion 244*b*.

For instance, the connecting portion 245 may include a first connecting portion 246*a* for connecting the evaporating portion 241 with the first condensing portion 244*a*, a second connecting portion 246*b* for connecting the evaporating portion 241 with the second condensing portion 244*b*, and a third connecting portion 246*c* for connecting the second condensing portion 244*b* with the third condensing portion 244*c*.

With such a configuration, in the heat pipe 230*c*, the operation fluid 234 evaporated from the evaporating portion 241 by absorbing peripheral heat may move to the first condensing portion 244*a*, the second condensing portion 244*b*, and the third condensing portion 244*c*.

The operation fluid 234 which has moved to the first condensing portion 244*a*, the second condensing portion 244*b*, and the third condensing portion 244*c* may emit heat on a larger area, thereby being condensed more rapidly.

With such a configuration, since heat of the defrosting heater 210 is transferred to an upper region of the evaporator 160 in a structure of the heat pipe 230*c*, defrosting the upper region of the evaporator 160 may be accelerated.

Specific embodiments of the present invention have been explained. However, the present features can be embodied in several forms without departing from the characteristics thereof. Therefore, it should also be understood that the above-described embodiments are not limited by any of the details of the foregoing description.

Further, even embodiments which have not been explained in more detail in the detailed description should be construed broadly within its scope as defined in the appended claims. And all changes and modifications that fall within the metes and bounds of the claims, or equivalents of such metes and bounds are therefore intended to be embraced by the appended claims.

The invention claimed is:

1. A refrigerator with a defrosting device, comprising:

a refrigerator main body;

an evaporator provided at the refrigerator main body;

a defrosting heater provided below the evaporator that is configured to emit heat when power is applied to the defrosting heater;

a heat pipe with a first side arranged at one side of the defrosting heater and that is configured to absorb heat, and with a second side that is configured to transfer heat to the evaporator; and a supporting holder coupled to a refrigerant pipe of the evaporator and configured to support the heat pipe in a spaced manner from the defrosting heater by a preset distance, wherein the supporting holder includes:

a refrigerant pipe accommodating portion coupled to the refrigerant pipe of the evaporator;

a defrosting heater accommodating portion that is configured to accommodate the defrosting heater; and a heat pipe accommodating portion that is configured to accommodate the heat pipe in a spaced state from the defrosting heater accommodating portion by the preset distance, and wherein the heat pipe accommodating portion is disposed above the defrosting heater accommodating portion, and disposed below the refrigerant pipe accommodating portion.

2. The refrigerator with a defrosting device of claim 1, wherein the heat pipe includes:

an evaporating portion provided at one side of the defrosting heater;

a condensing portion spaced apart from the evaporating portion; and a connecting portion for communicating the evaporating portion and the condensing portion with each other.

3. The refrigerator with a defrosting device of claim 1, wherein the supporting holder is provided with a heat pipe fixing pieces for fixing the heat pipe by being bent in order to prevent separation of the heat pipe accommodated in the heat pipe accommodating portion.

4. The refrigerator with a defrosting device of claim 1, wherein the heat pipe accommodating portion is formed outside the defrosting heater accommodating portion in a diagonal direction, based on a center of the evaporator in a thickness direction.

5. The refrigerator with a defrosting device of claim 1, wherein the supporting holder is provided with a defrosting heater supporting piece provided at the defrosting heater accommodating portion, the defrosting heater supporting piece for supporting the defrosting heater by being bent before the defrosting heater is accommodated and by returning to an initial position after the defrosting heater is accommodated.

6. The refrigerator with a defrosting device of claim 1, wherein the supporting holder is provided with a heat pipe supporting piece provided at the heat pipe accommodating portion, the heat pipe supporting piece for supporting the heat pipe by being bent before the heat pipe is accommodated and by returning to an initial position after the heat pipe is accommodated.

7. The refrigerator with a defrosting device of claim 1, wherein a collar bent in order to increase a contact area with the defrosting heater or the heat pipe is formed at one of the defrosting heater accommodating portion and the heat pipe accommodating portion.

8. The refrigerator with a defrosting device of claim 2, wherein the connecting portion is upward bent from one end of the evaporating portion, and the condensing portion is bent at an end of the connecting portion.

9. The refrigerator with a defrosting device of claim 2, wherein the condensing portion is provided with a first condensing portion and a second condensing portion spaced apart from each other in upper and lower directions, and wherein the connecting portion includes a first connecting portion bent from the evaporating portion and configured to connect the evaporating portion with the first condensing portion, and a second connecting portion bent from the first condensing portion and connected to the second condensing portion.

10. The refrigerator with a defrosting device of claim 2, wherein the connecting portion is provided with a first connecting portion and a second connecting portion upward bent from two ends of the evaporating portion, and wherein the condensing portion is provided with a first condensing portion bent from an end of the first connecting portion and a second condensing portion bent from an end of the second connecting portion.

11. The refrigerator with a defrosting device of claim 2, wherein the condensing portion is provided with a first condensing portion, a second condensing portion and a third condensing portion spaced apart from each other in upper and lower directions, and wherein the connecting portion is provided with a first connecting portion and a second connecting portion upward bent from two ends of the evaporating portion, and a third connecting portion bent from the second condensing portion and connected to the third condensing portion.

12. The refrigerator with a defrosting device of claim 1, wherein the refrigerant pipe has a plurality of horizontal sections spaced apart from each other in upper and lower directions, wherein the evaporator further includes a plurality of cooling fins coupled to the horizontal sections, and wherein a heat pipe supporting portion for partially accommodating and supporting the heat pipe is provided at the cooling fins.

* * * * *